US009708842B1

(12) United States Patent
Giese

(10) Patent No.: US 9,708,842 B1
(45) Date of Patent: Jul. 18, 2017

(54) GARAGE DOOR SAFETY DEVICE

(71) Applicant: Benjamin C. Giese, Burke, VA (US)

(72) Inventor: Benjamin C. Giese, Burke, VA (US)

(73) Assignee: Buena Vista Investments Ltd., Nursery, TX (US)

( * ) Notice: Subject to any disclaimer, the term of this patent is extended or adjusted under 35 U.S.C. 154(b) by 0 days.

(21) Appl. No.: 15/402,837

(22) Filed: Jan. 10, 2017

(51) Int. Cl.
*E05D 15/00* (2006.01)
*E05D 13/00* (2006.01)

(52) U.S. Cl.
CPC ..... *E05D 13/003* (2013.01); *E05D 13/1269* (2013.01); *E05D 13/1261* (2013.01); *E05Y 2900/106* (2013.01)

(58) Field of Classification Search
CPC . E05D 13/12; E05D 13/1292; E05D 13/1223; E05D 13/1238; E05D 13/1269; E05D 13/003; E05D 13/006; E05D 13/1261; A62B 1/10; A62B 35/0093; B66D 5/04; B66D 1/54; F16D 2043/145; B64F 1/02
USPC ..... 160/296
See application file for complete search history.

(56) References Cited

U.S. PATENT DOCUMENTS 1,936,269 A 11/1933 Schaffert et al.
2,012,336 A 8/1935 Blodgett
2,064,470 A 12/1936 Heckman
2,099,191 A 11/1937 Blodgett
2,185,828 A 1/1940 Blodgett
2,294,360 A 9/1942 Blodgett
3,412,423 A * 11/1968 Binns ..... E05D 13/1261 16/198
3,412,780 A 11/1968 Moler
4,385,471 A 5/1983 Gabry et al.
4,520,591 A 6/1985 Calvagno
4,604,828 A 8/1986 Baarse
4,914,862 A 4/1990 Gregory
4,956,938 A 9/1990 DeMent
5,046,544 A 9/1991 Coluccio
5,291,686 A 3/1994 Sears et al.
5,494,093 A * 2/1996 Eiterman ..... E05D 13/003 160/300
5,698,073 A 12/1997 Vincenzi
5,743,046 A 4/1998 Siegler et al.
(Continued)

FOREIGN PATENT DOCUMENTS

FR 2465678 B1 3/1981
FR 2758156 B1 7/1998

*Primary Examiner* — Katherine Mitchell
*Assistant Examiner* — Abe Massad
(74) *Attorney, Agent, or Firm* — Andrews Kurth Kenyon LLP

(57) ABSTRACT

A garage door assembly that includes a torsion spring counterbalance apparatus mounted on a header wall above a garage door, the apparatus including at least one spring wound on a shaft, also includes a safety device. The safety device includes a capture device mounted on the header wall above the garage door, and a catch device attached to the shaft at a location proximate to the capture device on the header wall. The catch device rotates with the torsion spring counterbalance shaft, and the catch device is capable of extending away from the shaft under centrifugal force to engage the capture device and thereby stop the garage door from further free-falling.

14 Claims, 4 Drawing Sheets

(56) References Cited

U.S. PATENT DOCUMENTS

| | | | | |
|---|---|---|---|---|
| 5,964,268 | A * | 10/1999 | Carper | E05D 13/1215 16/198 |
| 6,024,155 | A | 2/2000 | Sharp | |
| 6,042,158 | A | 3/2000 | Horn | |
| 6,089,304 | A * | 7/2000 | Mullet | E05D 13/1261 160/193 |
| 6,189,266 | B1 | 2/2001 | Mihalcheon | |
| 6,253,824 | B1 | 7/2001 | Mullet et al. | |
| 6,279,268 | B1 | 8/2001 | Beaudoin et al. | |
| 6,401,793 | B1 * | 6/2002 | Martin | E05D 13/1261 160/189 |
| 6,640,496 | B2 | 11/2003 | Mullet | |
| 6,715,236 | B2 | 4/2004 | Mullet | |
| 7,428,918 | B2 * | 9/2008 | Martin | E05D 13/003 160/191 |
| 9,464,479 | B1 * | 10/2016 | Kee | E05D 13/003 |
| 2006/0185800 | A1 * | 8/2006 | Beaudoin | E05D 13/1269 160/191 |
| 2007/0215292 | A1 * | 9/2007 | Mullet | E05D 13/1261 160/189 |

* cited by examiner

GARAGE DOOR SAFETY DEVICE

FIELD

Embodiments disclosed herein relate to garage doors. More specifically, embodiments disclosed herein relate to a safety device to stop or inhibit progress of a free-falling garage door.

BACKGROUND AND SUMMARY

A garage door is a large door on a garage that opens either manually or by an electric motor. Garage doors are frequently large enough to accommodate automobiles and other vehicles. Small garage doors may be made in a single panel that tilts up and back across the garage ceiling. Larger doors are usually made in several jointed panels that roll up on tracks across the garage ceiling, or into a roll above the doorway. The operating mechanism is spring-loaded or counterbalanced to offset the weight of the door and reduce human or motor effort required to operate the door.

A torsion spring counterbalance system consists of one or two tightly wound up springs on a steel shaft with cable drums at both ends. The entire apparatus mounts on the header wall above the garage door and has three supports: a center bearing plate with a steel or nylon bearing and two end bearing plates at both ends. The springs themselves consist of the steel wire with a stationary cone at one end and a winding cone at the other end. The stationary cone is attached to the center bearing plate. The winding cone consists of holes every 90 degrees for winding the springs and set screws to secure the springs to the shaft. Steel counterbalance cables run from the roller brackets at the bottom corners of the door to a notch in the cable drums. When the door is raised, the springs unwind and the stored tension lifts the door by turning the shaft, thus turning the cable drums, wrapping the cables around the grooves on the cable drums. When the door is lowered, the cables unwrap from the drums and the springs are rewound to full tension.

Garage doors may cause injury and property damage (including expensive damage to the door itself) in several ways. A common cause of injury is from falling garage doors. A garage door with a broken torsion spring, or the wrong strength torsion spring, can fall. Because the effective mass of the door increases as the garage door sections transfer from horizontal to vertical door tracks, a falling garage door accelerates rapidly.

What is needed then is a simple safety device that can stop or inhibit progress of a free-falling garage door.

In one aspect, embodiments disclosed herein relate to a garage door assembly including a torsion spring counterbalance apparatus mounted on a header wall above a garage door, the apparatus including at least one spring wound on a shaft, and a safety device, the safety device including a capture device mounted on the header wall above the garage door, and a catch device attached to the shaft at a location proximate to the capture device on the header wall. The catch device rotates with the torsion spring counterbalance shaft, and the catch device is capable of extending away from the shaft under centrifugal force to engage the capture device and thereby stop the garage door from further free-falling.

In another aspect, embodiments disclosed herein relate to a garage door assembly including a torsion spring counterbalance apparatus mounted on a header wall above a garage door, the apparatus including at least one spring wound on a shaft, and a safety device, the safety device including a hook mounted on the header wall above the garage door, and a chain attached at two locations along a length of the counterbalance shaft proximate to the hook, wherein a length of the chain between the two attachment locations is greater than the shaft length between the two attachment locations. When the shaft is rotating without resistance from the torsion spring counterbalance apparatus, the chain is configured to extend away from the shaft under centrifugal force and engage the hook to stop the garage door from free-falling.

In yet another aspect, embodiments disclosed herein relate to a method of stopping a free-falling garage door, the garage door including a torsion spring counterbalance apparatus mounted on a header wall above the garage door and having at least one spring wound on a shaft, the method including providing a catch device attached to the shaft and that rotates with the shaft, and further providing a capture device attached to the header wall and proximate to the catch device, and configuring the catch device and corresponding capture device, such that when lowering the garage door and rotating the shaft at a lower speed due to increasing resistance provided by the torsion spring counterbalance apparatus, the catch device does not engage the capture device. The catch device and corresponding catch device are also configured such that when lowering the garage door and rotating the shaft at a higher speed due to little or no resistance provided by the torsion spring counterbalance apparatus, the catch device extends away from the shaft due to centrifugal force and engages the capture device, and thereby stops further lowering the garage door.

BRIEF DESCRIPTION OF THE DRAWINGS

The invention is illustrated in the accompanying drawings wherein.

DETAILED DESCRIPTION

Figure 1:
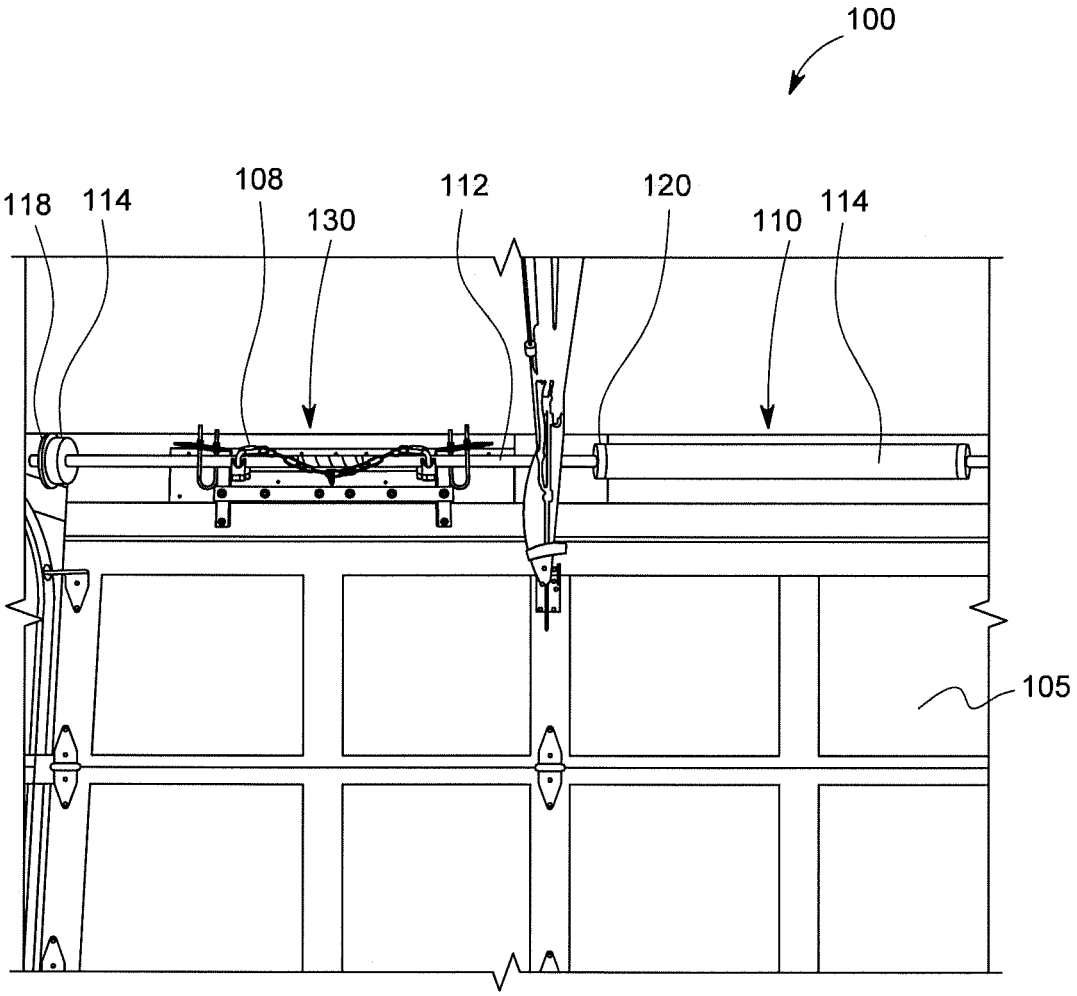
FIG. 1 illustrates a front view of a garage door assembly including an embodiment of a garage door safety device.

Embodiments disclosed herein relate to a garage door anti-free-fall safety device that is used to stop a garage door from free falling, for example, in the event that a torsion spring counterbalance malfunctions or fails. A garage door assembly may include a torsion spring counterbalance apparatus mounted on a header wall above a garage door. The torsion spring counterbalance apparatus may include at least one spring on a shaft with cable drums at both ends, and three supports including a center bearing plate with a bearing, and two end bearing plates with bearings at both ends.

As discussed, the torsion spring counterbalance system consists of one or two tightly wound up springs on a steel shaft with cable drums at both ends. The springs themselves consist of the steel wire with a stationary cone at one end and a winding cone at the other end. The stationary cone is attached to the center bearing plate. The winding cone consists of holes every 90 degrees for winding the springs and set screws to secure the springs to the shaft. Steel counterbalance cables run from the roller brackets at the bottom corners of the door to a notch in the cable drums. When the door is raised, the springs unwind and the stored tension lifts the door by turning the shaft, thus turning the cable drums, wrapping the cables around the grooves on the cable drums. When the door is lowered, the cables unwrap from the drums and the springs are rewound to full tension.

The safety device is generally installed at some location along the length of the torsion spring counterbalance shaft. The safety device includes a catch device that is attached to the counterbalance shaft. The catch device is any device that can be caught by a capture device, as explained below. In certain embodiments, the catch device may be a flexible cord attached at two locations along a length of the counterbalance shaft. A distance between the two attachment locations may be any distance, such as 3 inches or greater, or 6 inches or greater, or 12 inches or greater, or 15 inches or greater, or 18 inches or greater, or 24 inches or greater. The flexible cord as used herein may include a chain, rope, cord, cable, strap, belt, or other similar flexible length of any type of material. The flexible cord is of a length between the two attachment locations that is greater than the shaft length between the two attachment locations. That is, there is some "slack" in the flexible cord and the flexible cord may extend away from the shaft by hanging downward (due to gravity), or in other directions away from the shaft due to centrifugal force caused by fast rotation of the shaft. The flexible cord may be any length, such as 6 inches or greater, or 12 inches or greater, or 18 inches or greater, or 24 inches or greater, or 30 inches or greater. The flexible cord may be attached to the torsion spring counterbalance shaft with cable clamps that are sized appropriately to correspond with the torsion spring counterbalance shaft diameter. Quick-link devices may be used to attach ends of the flexible cord to the cable clamps. In other embodiments, the catch device may be a ring or anchor shackle attached at some location along the length of the torsion spring counterbalance shaft. The anchor shackle may be attached directly to the torsion spring counterbalance shaft in a manner that does not allow the anchor shackle to twist, or attached at an end of a chain that is attached to the torsion spring counterbalance shaft. The anchor shackle may be configured to rotate with the torsion spring counterbalance shaft.

The safety device further includes a capture device mounted on the header wall above the garage door at a location between the two flexible cord attachment locations on the counterbalance shaft. The capture device may be mounted to a steel bar that is secured to the header wall above the garage door. Additional steel bars and configurations may be used for further reinforcement. For example, the steel reinforcement may be steel plate or bars that are cut to a length to provide adequate reinforcement, such as 12 inches or greater, or 18 inches or greater, or 20 inches or greater, or 24 inches or greater, or 30 inches or greater. Steel bars may be secured to the header wall using any type of fasteners, including bolts or lag screws or other fasteners types. The capture device as used herein may include a hook, a nail, a bolt, or any type of device that can be configured having a portion that is curved or indented so that this portion can be used to hold or catch or capture another object, e.g., here the flexible cord, as will be explained below. The capture device may be at a certain distance from the torsion spring counterbalance shaft that is appropriate to allow it to properly catch or capture the catch device, e.g., the flexible cord. For example, the capture device may extend outward from the header wall and be at a distance from the torsion spring counterbalance shaft of ¼ inch or greater, or ½ inch or greater, or 1 inch or greater, or 2 inches or greater.

The safety device may further include U-bolts that are secured to the header wall above the garage door and installed and fixed around the torsion spring counterbalance shaft. The U-bolts are configured to keep the torsion spring counterbalance shaft at a distance from the header wall in the event the shaft flexes towards the header wall, as will be explained below. The U-bolts are spaced apart at a distance greater than the two attachment locations for the catch device, e.g., the flexible cord. In other words, the two attachment locations for the catch device, e.g., the flexible cord, are located between the U-bolts. For example, the U-bolts may be spaced at any distance apart, such as 8 inches or greater, or 12 inches or greater, or 18 inches or greater, or 24 inches or greater, or 30 inches or greater.

In certain embodiments, methods of operating a garage door include providing a catch device attached to the shaft and that rotates with the shaft, and further providing a capture device attached to the header wall and proximate to the catch device. The method further includes configuring the catch device and corresponding capture device such that when rotating the shaft at a speed that is lower due to increasing torsion provided by the torsion spring counterbalance apparatus, the catch device does not engage the capture device. On the other hand, when rotating the shaft at a speed that is higher due to little or no torsion provided by the torsion spring counterbalance apparatus, the catch device extends away from the shaft due to centrifugal force and engages the capture device.

FIG. 1 illustrates a front view of a garage door assembly 100. The garage door assembly 100 includes a torsion spring counterbalance apparatus 110 mounted on a header wall 108 above a garage door. The torsion spring counterbalance apparatus 110 includes a spring 114 that is wound on a shaft 112. The shaft 112 includes cable drums 116 at both ends, and three supports including a center bearing plate 120 with a bearing, and two end bearing plates 118 (only one is shown) with bearings at both ends. The garage door assembly 100 further includes a garage door safety device 130 that is installed along a portion of the torsion spring counterbalance shaft 112.

Figure 2:
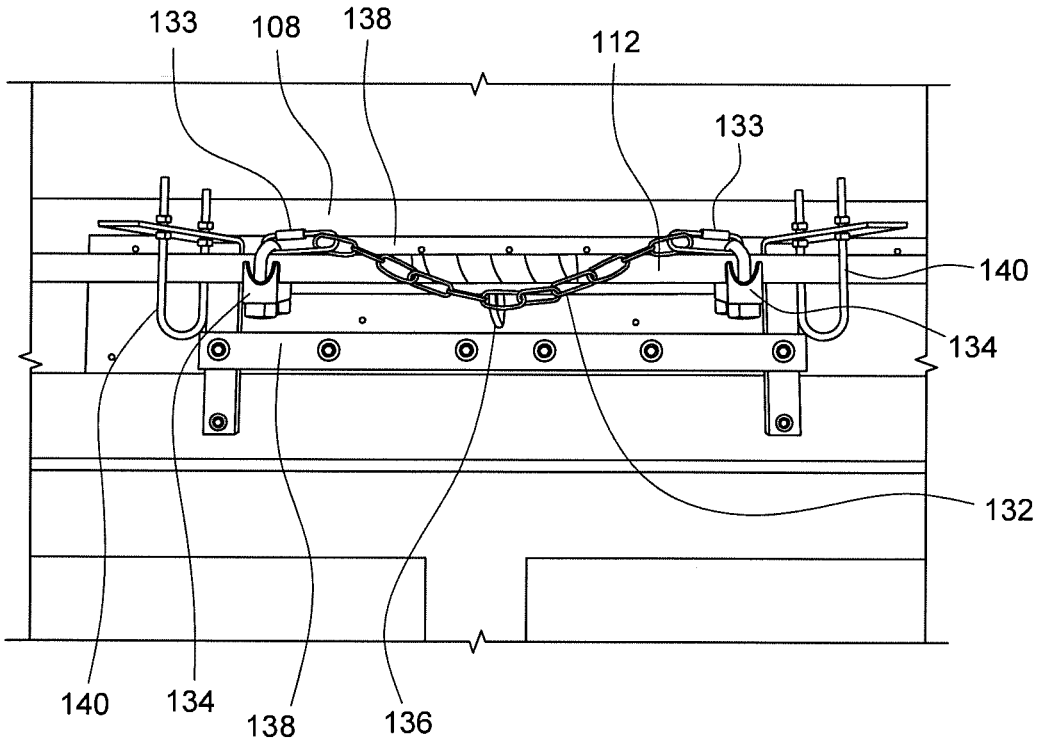
FIG. 2 illustrates a front view of an embodiment of the garage door safety device.

FIG. 2 illustrates a front view of a garage door safety device 130. The safety device 130 includes a chain 132 attached with cable clamps 134 at two locations along a length of the counterbalance shaft 112. The chain 132 is of a length between the cable clamps 134 that is greater than the shaft 112 length between the two cable clamps 134. That is, as illustrated, there is some "slack" in the chain 132 and the chain 132 may extend away from the shaft 112 by hanging downward (due to gravity), or in other directions away from the shaft 112 due to centrifugal force caused by fast rotation of the shaft 112. Quick-link devices 133 may be used to attach ends of the chain 132 to the cable clamps 134.

Figure 5:
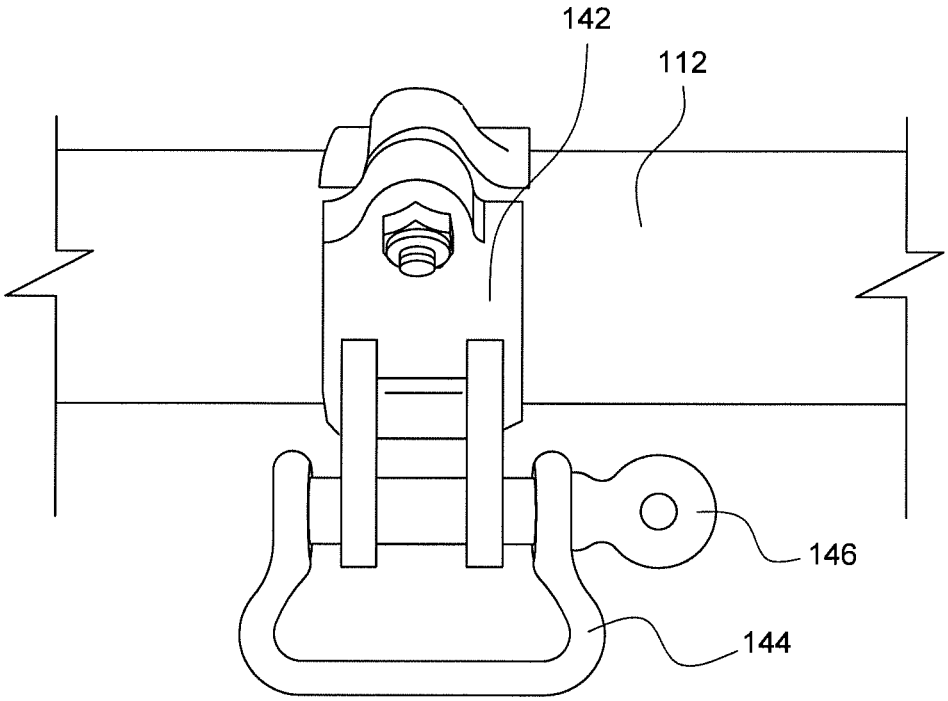
FIG. 5 illustrates a front view of an alternate embodiment of a garage door safety device.

FIG. 5 illustrates a front view of an alternate embodiment of a safety device that includes an anchor shackle 144 attached by way of a pin 146 to a clamp device 142 attached to the torsion spring counterbalance shaft 112. The clamp device 142 and anchor shackle 144 may be configured to rotate with the torsion spring counterbalance shaft 112. The anchor shackle 144 may be configured to be attached to the clamp device 142 in a manner that does not allow the anchor shackle to twist.

The safety device 130 further includes a hook 136 mounted on the header wall 108 above the garage door. The hook 136 is mounted at a location on the header wall 108 that is between the two chain attachment cable clamps 134 on the counterbalance shaft 112. The hook 136 may be mounted to a steel bar 138 that is secured to the header wall 108 above the garage door. Additional steel bars 138 may be used for further reinforcement. The hook 136 is used to hold or catch or capture the chain 132, as will be explained below.

The safety device 130 further includes U-bolts 140 that are secured to the header wall 108 above the garage door and installed and fixed around the torsion spring counterbalance shaft 112. The U-bolts 140 are configured to keep the torsion spring counterbalance shaft 112 at a distance from the header wall 108 in the event the shaft 112 flexes towards the header wall 108, as will be explained below.

The safety device 130 is configured to stop the garage door from free falling in the event that the torsion spring counterbalance malfunctions or fails, i.e., the torsion spring counterbalance provides little or no torsion against downward movement of the garage door. The safety device 130 uses centrifugal force that is created when the torsion spring counterbalance shaft 112 rapidly rotates (due to failure or malfunction of the torsion spring counterbalance spring 114). Centrifugal force causes the chain 132 to extend outward and away from the shaft 112 to catch the hook 136 mounted on the header wall 108 above the garage door 105, and thereby stop the garage door from further free falling.

In the event that an anchor shackle 142 is used, when the garage door is opening or closing at normal speeds, the anchor shackle 142 rests against the top of the shaft 112 until it rotates past the hook 136 and gravity causes the anchor shackle 142 to fall, missing the hook 136. As the shaft 112 continues slowly rotating, the anchor shackle 142 falls back against the shaft 112 as the shackle 142 ascends to the top of the rotating shaft. When the shaft 112 rotates more quickly due to a broken or malfunctioning torsion spring 114, centrifugal force causes the anchor shackle 142 to become fully extended to a position where it catches the hook 136.

Figure 3:
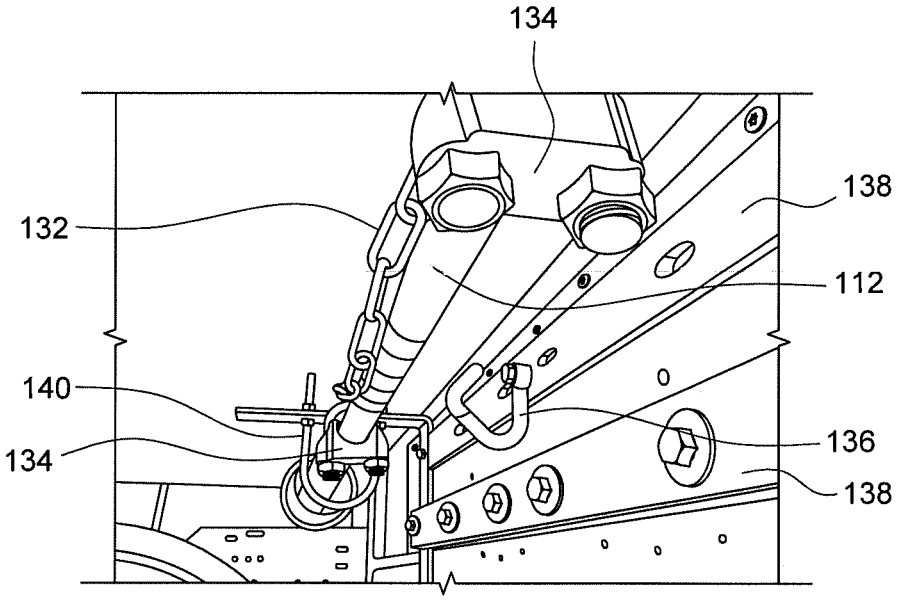
FIG. 3 illustrates a side perspective view of an embodiment of the garage door safety device.
Figure 4:
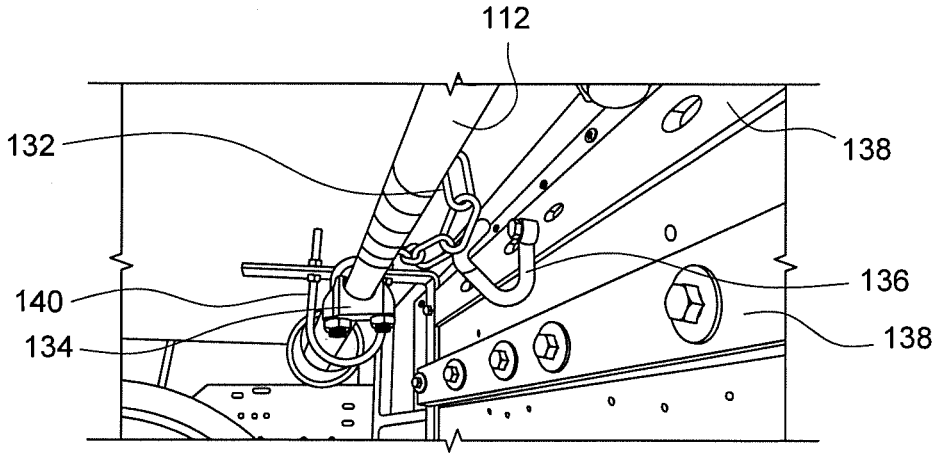
FIG. 4 illustrates a side perspective view of an embodiment of the garage door safety device.

In certain instances, upon stopping a free-falling door, the weight of the door may cause the shaft 112 to flex or move toward the header wall 108. The U-bolts 140 are configured to prevent the shaft 112 from flexing too much and contacting the header wall 108. The U-bolts 140 are configured to keep the torsion spring shaft 112 at a certain distance from the header wall in the event that the weight of the door causes the shaft 112 to flex too much. FIG. 3 illustrates a side perspective view of an embodiment of the safety device 130. FIG. 4 illustrates a side perspective view of an embodiment of the safety device 130, the chain 132 rotated toward the hook 136 and close to engaging the hook 112.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A garage door assembly comprising a torsion spring counterbalance apparatus mounted on a header wall above a garage door, the apparatus comprising at least one spring wound on a shaft, and a safety device, the safety device comprising:

a capture device mounted on the header wall above the garage door; and a catch device attached to the shaft at a location proximate to the capture device on the header wall, wherein the catch device rotates with the torsion spring counterbalance shaft, and wherein the catch device is capable of extending away from the shaft under centrifugal force to engage the capture device and thereby stop the garage door from further free-falling, wherein the catch device comprises a flexible cord attached to the counterbalance shaft at two locations along a length of the counterbalance shaft.

2. The assembly of claim 1, wherein a length of the cord between the two attachment locations is greater than the shaft length between the two attachment locations.

3. The assembly of claim 1, wherein the flexible cord is a chain.

4. The assembly of claim 1, wherein the capture device is a hook.

5. The assembly of claim 1, wherein the capture device is located on the header wall between the two attachment locations on the counterbalance shaft.

6. The assembly of claim 1, wherein the torsion spring counterbalance apparatus further comprises cable drums on both ends of the shaft, and a center bearing plate support with a bearing, and two end bearing plate supports with bearings at both ends.

7. The assembly of claim 1, further comprising U-bolts that are secured to the header wall and installed and fixed around the torsion spring counterbalance shaft, wherein the U-bolts are configured to keep the torsion spring counterbalance shaft at a distance from the header wall in the event the shaft flexes towards the header wall.

8. A garage door assembly comprising a torsion spring counterbalance apparatus mounted on a header wall above a garage door, the apparatus comprising at least one spring wound on a counterbalance shaft, and a safety device, the safety device comprising:

a hook mounted on the header wall above the garage door; and a chain attached to the counterbalance shaft at two locations along a length of the counterbalance shaft proximate to the hook, wherein a length of the chain between the two attachment locations is greater than the shaft length between the two attachment locations, and wherein when the shaft is rotating without resistance from the torsion spring counterbalance apparatus, the chain is configured to extend away from the shaft under centrifugal force and engage the hook to stop the garage door from free-falling.

9. The safety device of claim 8, further comprising U-bolts that are secured to the header wall and installed and fixed around the torsion spring counterbalance shaft, wherein the U-bolts are configured to keep the torsion spring counterbalance shaft at a distance from the header wall in the event the shaft flexes towards the header wall.

10. The safety device of claim 8, further comprising cable clamps that secure the chain to the counterbalance shaft at the two attachment locations.

11. A method of stopping the garage door assembly of claim 1 in the event of a free-fall, the method comprising:

providing the catch device attached to the shaft and that rotates with the shaft, and further providing the capture device attached to the header wall and proximate to the catch device;

configuring the catch device and corresponding capture device such that:

when lowering the garage door and rotating the shaft at a lower speed due to increasing resistance provided by the torsion spring counterbalance apparatus, the catch device does not engage the capture device; and when lowering the garage door and rotating the shaft at a higher speed due to little or no resistance provided by the torsion spring counterbalance apparatus, the catch device extends away from the shaft due to centrifugal force and engages the capture device, and thereby stops further lowering the garage door.

12. The method of claim 11, wherein the catch device is a chain attached at two locations along a length of the counterbalance shaft.

13. The method of claim 12, wherein a length of the chain between the two attachment locations is greater than the shaft length between the two attachment locations.

14. The method of claim 11, wherein the capture device is a hook mounted on the header wall at a location between the two chain attachment locations on the shaft.

* * * * *